US008292654B2

(12) United States Patent
Yasui

(10) Patent No.: US 8,292,654 B2
(45) Date of Patent: Oct. 23, 2012

(54) ELECTRONIC APPARATUS AND BATTERY CONNECTOR

(75) Inventor: Satoru Yasui, Kokubunji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/175,118

(22) Filed: Jul. 1, 2011

(65) Prior Publication Data

US 2012/0094540 A1 Apr. 19, 2012

(30) Foreign Application Priority Data

Oct. 15, 2010 (JP) ..... 2010-232844

(51) Int. Cl.
*H01R 13/64* (2006.01)

(52) U.S. Cl. ..... 439/378; 439/680

(58) Field of Classification Search ..... 439/224, 439/680, 378, 374
See application file for complete search history.

(56) References Cited

U.S. PATENT DOCUMENTS

2009/0149057 A1* 6/2009 Takeda ..... 439/374

FOREIGN PATENT DOCUMENTS

| | | |
|---|---|---|
| JP | H08-190103 A2 | 7/1996 |
| JP | 2000-150027 | 5/2000 |
| JP | 2001-267015 | 9/2001 |
| JP | 2003-123911 | 4/2003 |
| JP | 2006-228683 | 8/2006 |
| JP | 2007-299701 A2 | 11/2007 |

OTHER PUBLICATIONS

Japanese Office Action mailed Oct. 11, 2011 in connection with Japanese Application No. JP 2010-232844.
Japanese Office Action mailed Dec. 13, 2011 in connection with Japanese Application No. JP 2011-251949.

* cited by examiner

*Primary Examiner* — Ross Gushi
(74) *Attorney, Agent, or Firm* — Knobbe, Martens, Olson & Bear LLP

(57) ABSTRACT

According to one embodiment, an electronic apparatus includes a battery connector. The battery connector includes a plurality of signal terminals separated from each other by a first distance, a positive terminal separated from the plurality of signal terminals by a second distance greater than the first distance, an insulative positioning pin between the plurality of signal terminals and the positive terminal, protruding farther than the positive terminal, and a negative terminal separated from the plurality of signal terminals by a third distance greater than the first distance and protruding farther than the positive terminal, the plurality of signal terminals being between the positioning pin and the negative terminal.

11 Claims, 6 Drawing Sheets

ELECTRONIC APPARATUS AND BATTERY CONNECTOR

CROSS-REFERENCE TO RELATED APPLICATIONS

This application is based upon and claims the benefit of priority from Japanese Patent Application No. 2010-232844, filed Oct. 15, 2010; the entire contents of which are incorporated herein by reference.

FIELD

Embodiments described herein relate generally to a battery connector and an electronic apparatus comprising the same.

BACKGROUND

A connector comprises a plurality of signal terminals and power terminal. The signal terminals and the power terminal are arranged at regular intervals.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an electronic apparatus comprises a battery connector. The battery connector comprises a plurality of signal terminals separated from each other by a first distance, a positive terminal separated from the plurality of signal terminals by a second distance greater than the first distance, an insulative positioning pin between the plurality of signal terminals and the positive terminal, protruding farther than the positive terminal, and a negative terminal separated from the plurality of signal terminals by a third distance greater than the first distance and protruding farther than the positive terminal, the plurality of signal terminals being between the positioning pin and the negative terminal.

Hereinafter, embodiments will be described with reference to the accompanying drawings.

FIGS. 1 to 8 show an electronic apparatus 1 according to an embodiment. The electronic apparatus 1 is, for example, a notebook type personal computer. The electronic apparatus to which the present embodiment is applicable is not limited to the aforementioned one. The present embodiment may be widely applicable to a variety of electronic apparatuses such as televisions, recording/reproducing apparatuses, mobile phones, personal digital assistants (PDAs), and game machines.

Figure 1:
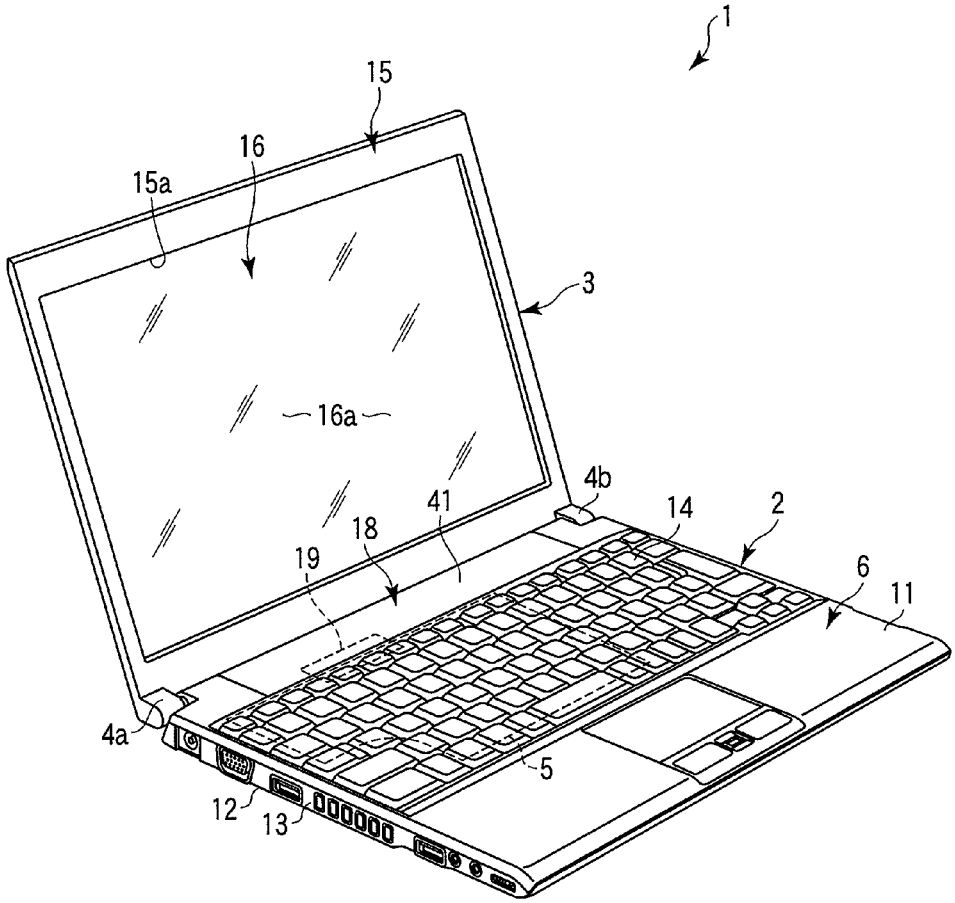
FIG. 1 is an exemplary perspective view of an electronic apparatus according to an embodiment.

As shown in FIG. 1, the electronic apparatus 1 comprises a main unit 2, a display unit 3, and hinges 4*a* and 4*b*. The main unit 2 is a main body of the electronic apparatus comprising a main circuit board 5 (first circuit board) therein. The main unit 2 comprises a casing 6 for accommodating the main circuit board 5 therein. The casing has a flat box shape including a top wall 11, a bottom wall 12, and peripheral walls 13.

The bottom wall 12 faces the surface of a desk when the electronic apparatus 1 is placed on the desk. The bottom wall 12 extends substantially in parallel with the surface of the desk. The top wall 11 extends substantially in parallel (i.e., substantially horizontally) with the bottom wall 12 with a space from the bottom wall 12. The top wall 11 is provided with a keyboard 14. The peripheral walls 13 stand with respect to the bottom wall 12, connecting an edge portion of the bottom wall 12 and an edge portion of the top wall 11.

The display unit 3 is pivotably (openably) connected to a rear end portion of the main unit 2 with the hinges 4*a* and 4*b*. The display unit 3 can be pivoted between a closed position, in which the display unit 3 is folded down to cover the main unit 2 from the upper side, and an open position, in which the display unit 3 is raised with respect to the main unit 2.

As shown in FIG. 1, the display unit 3 comprises a display casing 15 and a display panel 16 in the display casing 15. A display screen 16*a* of the display panel 16 can be externally exposed through an opening 15*a* in the front wall of the display casing 15.

Figure 2:
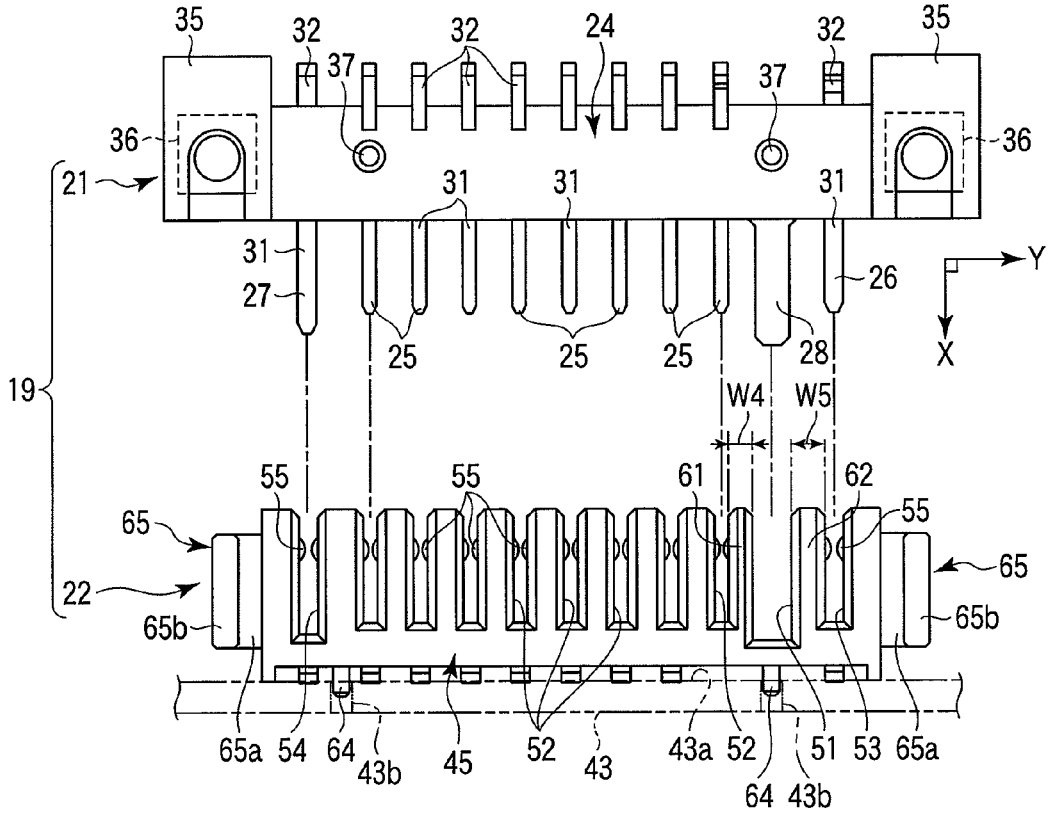
FIG. 2 is an exemplary bottom view of a battery connector of the electronic apparatus of FIG. 1.

As shown in FIG. 1, the electronic apparatus 1 comprises a battery 18 and a battery connector 19 for electrically connecting the battery 18 to the main unit 2. As shown in FIG. 2, the battery connector 19 comprises a first connector 21 (e.g., male portion) on the main unit 2 and a second connector 22 (e.g., female portion) on the battery 18 and detachably engaged with the first connector 21.

In the exemplary embodiment, the first connector 21 is, for example, on the main circuit board 5. The main unit 2 is electrically connected to the battery 18 by connecting the second connector 22 to the first connector 21. Alternatively, the first connector 21 may be on a circuit board different from other than the main circuit board 5 in the main unit 2. Furthermore, the first connector 21 may be provided on the battery 18, and the second connector 22 may be provided on the main unit 2.

Next, the first connector 21 will be described in detail with reference to FIGS. 2 to 5.

The first connector 21 includes a first housing 24 made of synthetic resin. The first housing 24 is provided with a plurality of signal terminals 25, a positive terminal 26, a negative terminal 27, and a positioning pin 28. Each of the positive and negative terminals 26 and 27 is an example of the "power terminal" (e.g., power supply terminal). Since a larger electric current flows through the positive and negative terminals 26 and 27 than the signal terminal 25, they are likely to generate heat as compared with the signal terminals 25.

Here, first to third directions X, Y, and Z are defined. The first direction X refers to the engaging direction of the battery connector 19, that is, the direction from the first connector 21 to the second connector 22. The second direction Y refers to the widthwise direction of the battery connector 19 and the direction in which the plurality of signal terminals 25 are arranged. The third direction Z refers to the thickness direction of the battery connector 19. The first to third directions X, Y, and Z are substantially perpendicular to one another.

As shown in FIGS. 2 to 5, the signal terminals 25 and the positive and negative terminals 26 and 27 are formed in a plate shape, in which the vertical width (the width in the third direction Z) is larger than the horizontal width (the width in the second direction Y). The signal terminals 25 and the positive and negative terminals 26 and 27 are formed in an L-shape including a first end portion 31 and a second end portion 32 bent from the first end portion 31.

The first end portion 31 protrudes in the first direction X. The first end portion 31 is an end portion connected to the second connector 22. The second end portion 32 is inserted into a through-hole (not shown) in the main circuit board 5 and electrically connected to the main circuit board 5, for example, using soldering or the like. That is, the first connector 21 is an insertion mounting type connector. Alternatively, the first connector 21 may be a surface mounting type connector.

Figure 3:
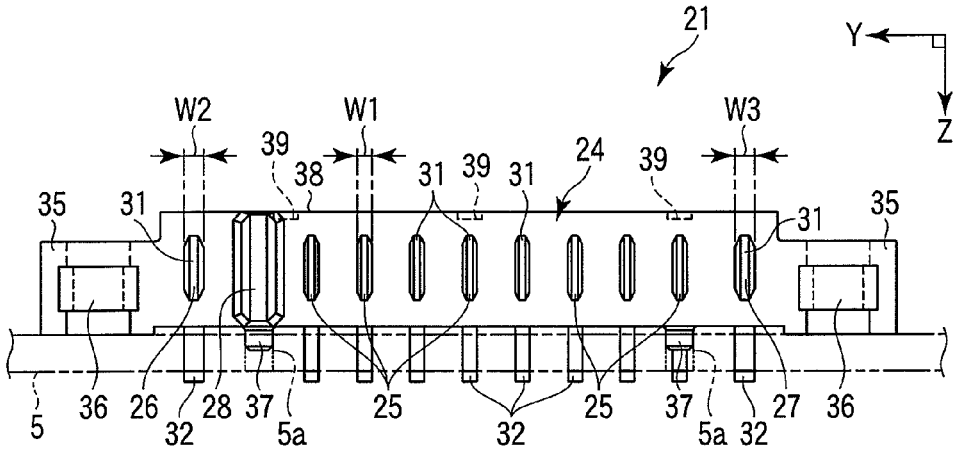
FIG. 3 is an exemplary front view of a first connector of FIG. 2.
Figure 4:
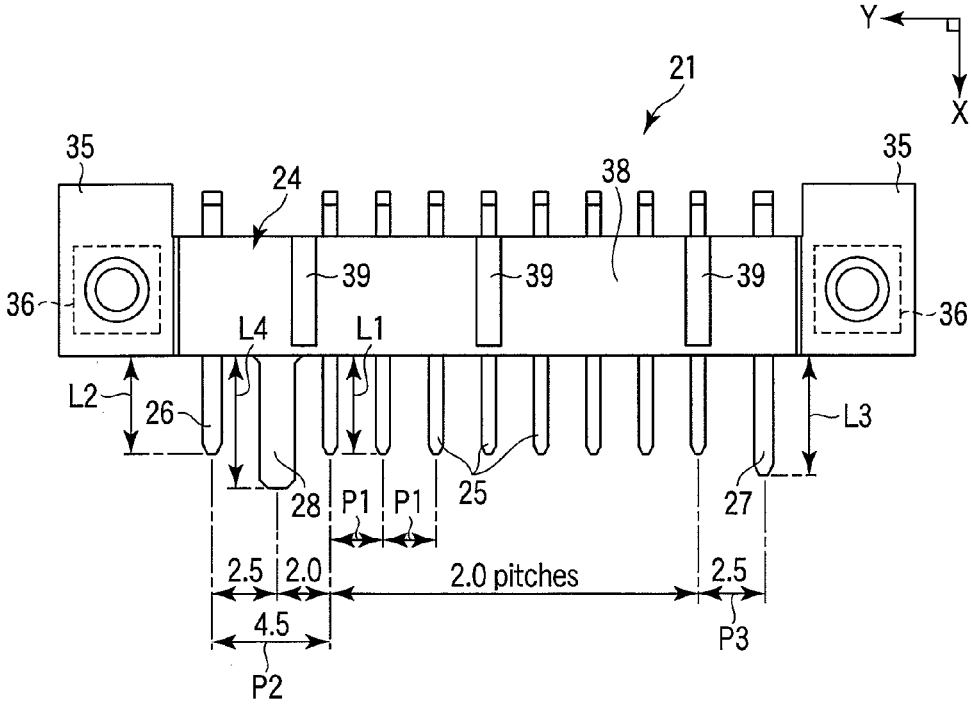
FIG. 4 is an exemplary plan view of the first connector of FIG. 2.
Figure 5:
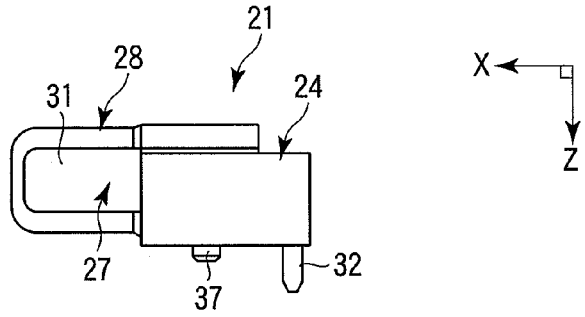
FIG. 5 is an exemplary side view of the first connector of FIG. 2.

As shown in FIGS. 2 to 4, the plurality of signal terminals 25 are arranged to be spaced apart from one another at an interval of a first distance P1. The first distance P1 is set to, for example, 2.0 mm. Herein, the "distance" refers to a distance between centers of the terminals.

The positive and negative terminals 26 and 27 are separately disposed at both sides of the plurality of signal terminals 25. The positive terminal 26 is separated from the signal terminals 25 by a second distance P2 larger than the first distance P1. The second distance P2 is set to, for example, 4.5 mm. The width W2 of the positive terminal 26 in the second direction Y is larger than the width W1 of the signal terminal 25. That is, the positive terminal 26 is thicker than the signal terminal 25. The protrusion amount L2 of the positive terminal 26 in the first direction X is substantially equal to the protrusion amount L1 of the signal terminal 25.

The positioning pin 28 is between the positive terminal 26 and the signal terminals 25. The positioning pin 28 is integrally formed with the first housing 24 and formed of synthetic resin having an insulation property. The protrusion amount L4 of the positioning pin 28 in the first direction X is larger than the protrusion amount L2 of the positive terminal 26. That is, the positioning pin 28 protrudes longer than the positive terminal 26 in the first direction X. For example, the positioning pin 28 is separated from the signal terminals 25 by a distance of 2.0 mm and also separated from the positive terminal 26 by a distance of 2.5 mm.

The negative terminal 27 is on the opposite side of the positioning pin 28 with respect to the signal terminals 25. The negative terminal 27 is separated from the signal terminals 25 by a third distance P3 larger than the first distance P1. The third distance P3 is shorter than the second distance P2 and is set to, for example, 2.5 mm. The third distance P3 corresponds to, for example, the distance between the positioning pin 28 and the positive terminal 26.

The width W3 of the negative terminal 27 in the second direction Y is larger than the width W1 of the signal terminal 25 and, for example, substantially equal to the width W2 of the positive terminal 26. That is, the negative terminal 27 is thicker than the signal terminal 25. The protrusion amount L3 of the negative terminal 27 in the first direction X is larger than the protrusion amount L2 of the positive terminal 26 and smaller than the protrusion amount L4 of the positioning pin 28. That is, the negative terminal 27 protrudes longer than the positive terminal 26 in the first direction X and is shorter than the positioning pin 28 in the first direction X.

As shown in FIGS. 2 to 4, each of both end portions of the first connector 2 is provided with a fixing portion 35. A nut 36 is provided in the fixing portion 35. The first connector 21 is fixed to the main circuit board 5 by attaching a screw to the nut 36.

The first housing 24 includes, for example, two bosses 37 protruding toward the main circuit board 5. The boss 37 is inserted into the through-hole 5*a* of the main circuit board 5 to control the position of the first connector 21 relative to the main circuit board 5. The positive terminal 26 is between one of the bosses 37 and the fixing portion 35 of one end portion of the first connector 21. The negative terminal 27 is between the other boss 37 and the fixing portion 35 of the other end of the first connector 21.

As shown in the FIGS. 3 and 4, the first housing 24 includes a flat portion 38 on the opposite side of the main circuit board 5. The flat portion 38 extends between the fixing portions 35 of both end portions of the first connector 21 substantially in parallel with the main circuit board 5. The flat portion 38 is provided with, for example, three recess portions 39. The first housing 24 is hollowed at the recess portions 39, thereby having steps in the flat portion 38. The recess portions 39 are deviated from the positive and negative terminals 26 and 27.

Figure 7:
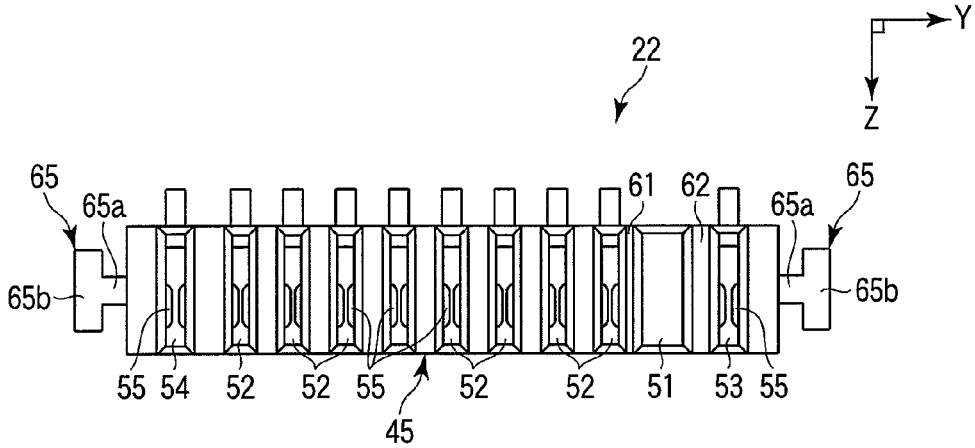
FIG. 7 is an exemplary front view of the second connector of FIG. 2.
Figure 8:
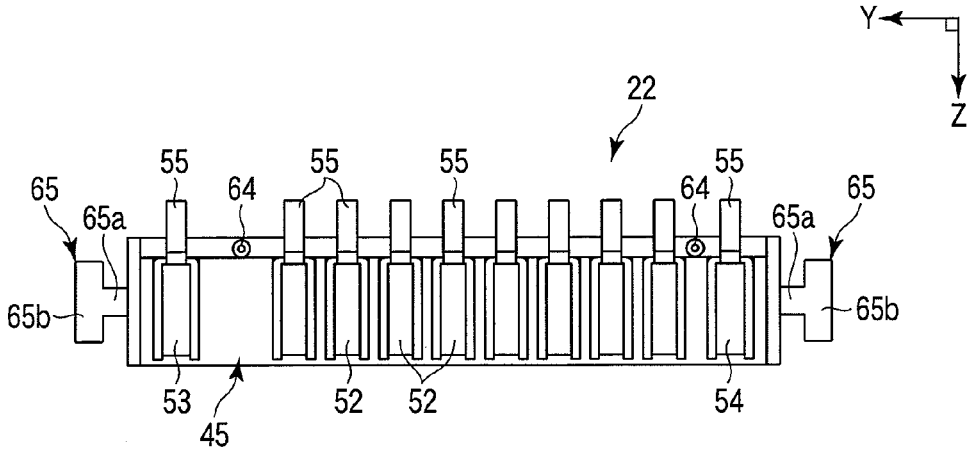
FIG. 8 is an exemplary rear view of the second connector of FIG. 2.

Next, the second connector 22 will be described in detail with reference to FIGS. 6 to 8.

Figure 6:
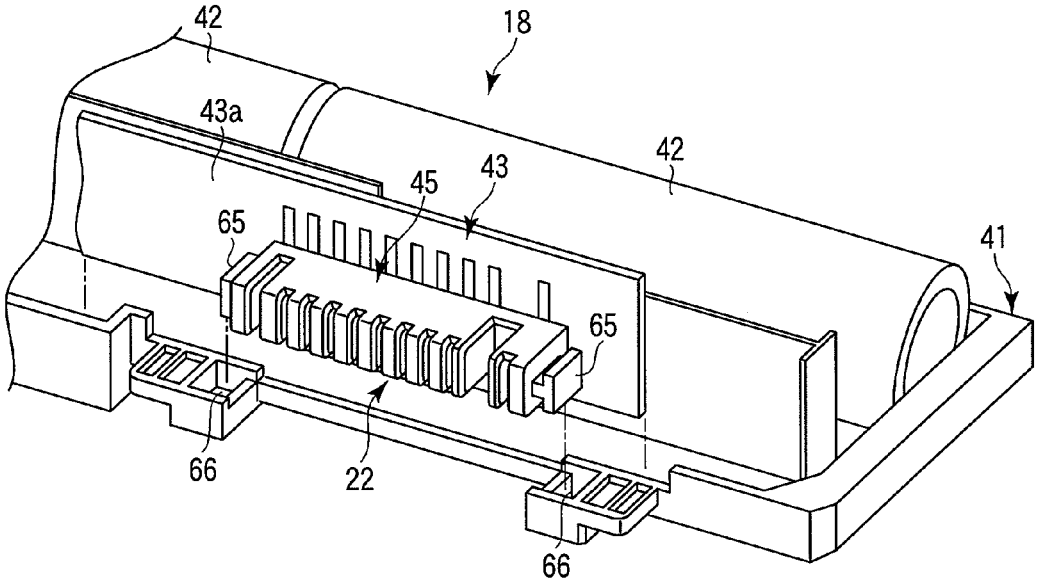
FIG. 6 is an exemplary perspective view of a battery and a second connector of the electronic apparatus of FIG. 1.

As shown in FIG. 6, the battery 18 comprises a battery casing 41, a rechargeable battery 42, and a circuit board 42 (second circuit board). The circuit board 43 is stored in the battery casing 41, for example, with an upright posture. The circuit board 43 includes a standing surface 43*a* extending vertically. The second connector 22 is on the standing surface 43*a* of the circuit board 43.

The second connector 22 includes a second housing 45 made of synthetic resin. The second housing 45 includes a first recess portion 51, a plurality of second recess portions 52, a third recess portion 53, and a fourth recess portion 54. The positioning pin 28 is inserted into the first recess portion 51. The signal terminals 25 are inserted into the second recess portions 52. The positive terminal 26 is inserted into the third recess portion 53. The negative terminal 27 is inserted into the fourth recess portion 54.

Each of the recess portions 52, 53, and 54 but not the first recess portion 51 is provided with a connection terminal 55 electrically connected to the circuit board 43. The connection terminal 55 comes into contact with the signal terminal 25, the positive terminal 26, or the negative terminal 27 inserted into each of the recess portions 52, 53, and 54 to electrically connect the first connector 21 to the second connector 22.

As shown in FIG. 2, the second recess portion 52 includes a first wall 61 between the first and second recess portions 51 and 52. The distance between centers of the first and second recess portions 51 and 52 is set to, for example, 2.0 mm. The third recess portion 53 is on the opposite side of the second recess portion 52 with respect to the first recess portion 51. The second wall 62 is between the first and third recess portions 51 and 53. The distance between centers of the first and third recess portions 51 and 53 is set to, for example, 2.5 mm. The second wall 62 is thicker than the first wall 61. That is, the width W4 (thickness) of the first wall 61 in the second direction Y is smaller than the width W5 of the second wall 62.

The second housing 45 includes two bosses 64, for example, protruding toward the circuit board 43. The boss 64 is inserted into the through-hole 43*b* of the circuit board 43 to control the position of the second connector 22 relative to the circuit board 43. The bosses 64 are deviated from the third and fourth recess portions 53 and 54.

As shown in FIG. 6, each of both end portions of the second connector 22 is provided with an engaging portion 65. The engaging portion 65 includes a first portion 65*a* extending in the side direction of the second connector 22 and a second portion 65*b* extending in a direction perpendicular to the first portion 65*a*. The second portion 65*b* extends in a direction in which the circuit board 43 and the battery 18 are installed to the battery casing 41.

The battery casing 41 is provided with a holder 66 engaged with the engaging portion 65 of the second connector 22. The holder 66 is a recess portion, for example, having a shape corresponding to the engaging portion 65. The positions of the second connector 22 and the circuit board 43 are controlled by engaging the engaging portion 65 with the holder 66.

This configuration allows miniaturization of the battery connector 19.

The battery connector 19 of the present embodiment includes a plurality of signal terminals 25 arranged to be spaced apart from one another at a regular interval of a first distance P1, a positive terminal 26 separated from the signal terminals 25 by a second distance P2 larger than the first distance P1, and a negative terminal 27 separated from the signal terminals 25 by a third distance P3 larger than the first distance P1. Here, since a larger electric current flows through the positive and negative terminals 26 and 27 than the signal terminal 25, they are likely to generate heat as compared with the signal terminals 25.

That is, the battery connector 19 of the present embodiment is configured in such a way that the power terminals 26 and 27, which are apt to generate heat, are separated from the signal terminals 25 by a predetermined distance and the signal terminals 25, through which a relatively small electric current flows, are densely disposed at a relatively small interval. This allows size reduction of the battery connector 19 as well as high safety.

In addition, the battery connector 19 of the present embodiment includes a negative terminal 27 protruding more than the positive terminal 26. For this reason, when the first connector 21 is engaged with the second connector 22, the negative terminal 27 comes into contact with the connection terminal 55 of the second connector 22 to be grounded before the positive terminal 26 comes into contact with the connection terminal 55 of the second connector 22.

For this reason, electricity such as static electricity that has collected in the first connector 21 is discharged, safety improves, and the electrical potential is more easily stabilized. In addition, even in the event that the first connector 21 is disengaged from the second connector 22, the negative terminal 27 out of all the terminals 25, 26, and 27 maintains contact with the connection terminal 55 of the second connector 22 till the last. Therefore, safety further improves.

In addition, the battery connector 19 of the present embodiment includes a positioning pin 28. As a result, it may be possible to prevent reverse insertion. Furthermore, if the positioning pin 28 protrudes more than the positive terminal 26, the positioning pin 28 serves as a protrusion barrier against a foreign object when the foreign object such as a metal piece having a plate shape is attached between the first and second connectors 21 and 22, for example. Therefore, the metal piece is unlikely to come into simultaneous contact with the positive and negative terminals 26 and 27. That is, it may be possible to prevent a short circuit between the positive and negative terminals 26 and 27.

In the battery connector 19 of the present embodiment, the relatively large positioning pin 28 is provided by effectively using an area between the signal terminals 25 and the positive terminal 26 which is relatively not narrow. As a result, as compared with the case where the positioning pin 28 is provided in other portions, the battery connector 19 may be effectively miniaturized.

Here, if the positioning pin 28 and the negative terminal 27 protruding relatively longer are arranged side by side with each other, the large terminals 27 and 28 are converged at one end portion of the first connector 21, and connectivity of the first connector 21 to the second connector 22 may be degraded.

Meanwhile, in the present embodiment, the positioning pin 28 is provided near the positive terminal 26, and the negative terminal 27 is provided on the opposite side of the positioning pin 28 with respect to the signal terminals 25. As a result, the positioning pin 28 and the negative terminal 27 each protruding more than the positive terminal 26 are separately arranged in both end portions of the first connector 21, respectively. Therefore, safety of the first connector 21 improves when the first connector 21 is connected to and disconnected from the second connector 22, and connection/disconnection workability thereof also improves.

In the battery connector 19 of the present embodiment, the battery connector 19 includes the first recess portion 51 which receives the positioning pin 28, the second recess portion 52 which receives the signal terminal 25, the first wall 61 provided between first and second recess portions 51 and 52, and the third recess portion 53 which receives the positive terminal 26. The third recess portion 53 is on the opposite side of the second recess portion 52 with respect to the first recess portion 51. The second wall 62 thicker than the first wall 61 is provided between the first and third recess portion 51 and 53.

For this reason, if an excessive force is applied to the battery connector 19 so that a load is added around the positioning pin 28, the first wall 61 more easily breaks than the second wall 62. That is, since the signal terminal through which a relatively small electric current flows breaks first rather than the power terminal through which a relatively large electric current flows, a large load is not applied to the power terminal. As a result, it is possible to obtain higher safety of the battery connector 19. In addition, since the first wall 61 is thinner than the second wall 62, it may be possible to facilitate miniaturization of the battery connector 19.

In the present embodiment, the positive and negative terminals 26 and 27 are thicker than the signal terminal 25. Therefore, even when a relatively large electric current flows through the positive and negative terminals 26 and 27, heat is unlikely to be generated.

In the present embodiment, the second connector 22 includes an engaging portion 65, and the battery 41 includes a holder 66 engaged with the engaging portion 65 of the second connector 22. Therefore, it is possible to position the second connector 22 with high precision and achieve good assembly efficiency.

If the first housing 24 includes a flat portion 38, the surface of the flat portion 38 is easily cooled during injection molding and is therefore solidified extremely quickly in comparison with other portions. For this reason, voids may remain in the product. If voids remain in the product, the voids may inflate during the reflow in the subsequent process so as to generate failures on the surface of the product.

Meanwhile, the first housing 24 of the present embodiment includes the recess portion 39 in the flat portion 38. If such a recess portion 39 is provided, it is difficult to cool the surface of the flat portion 38, and voids are not likely to remain inside the product. In the present embodiment, the recess portion 39 is deviated from the positive and negative terminals 26 and 27. Therefore, no step exists in the vicinity of the positive and negative terminals 26 and 27, and the strength of the first housing 24 increases. Accordingly, it is possible to increase safety of the vicinity of the positive and negative terminals 26 and 27 where a relatively large electric current flows.

Since a relatively large electric current flows through the positive and negative terminals 26 and 27, a large amount of heat is generated. Therefore, it can be said that the housing portion near the positive and negative terminals 26 and 27 is a portion apt to thermally expand.

In the present embodiment, the positive and negative terminals 26 and 27 are positioned between the boss 37 and the fixing portions 35 in the end portions of the first housing 24. That is, an area around the positive and negative terminals 26 and 27 that is apt to thermally expand is fixed in both sides by the boss 37 and the fixing portion 35 of the first housing 24. Therefore, the first connector 21 is more safely fixed so that unwanted inflation is suppressed and reliability readily increases.

Next, a modification of the present embodiment will be described with reference FIG. 9, in which the same reference numerals denote the same or similar elements as those in the above embodiment, and description thereof will not be repeated. In addition, it is assumed that configurations other than those described below are similar to those of the aforementioned embodiment.

Figure 9:
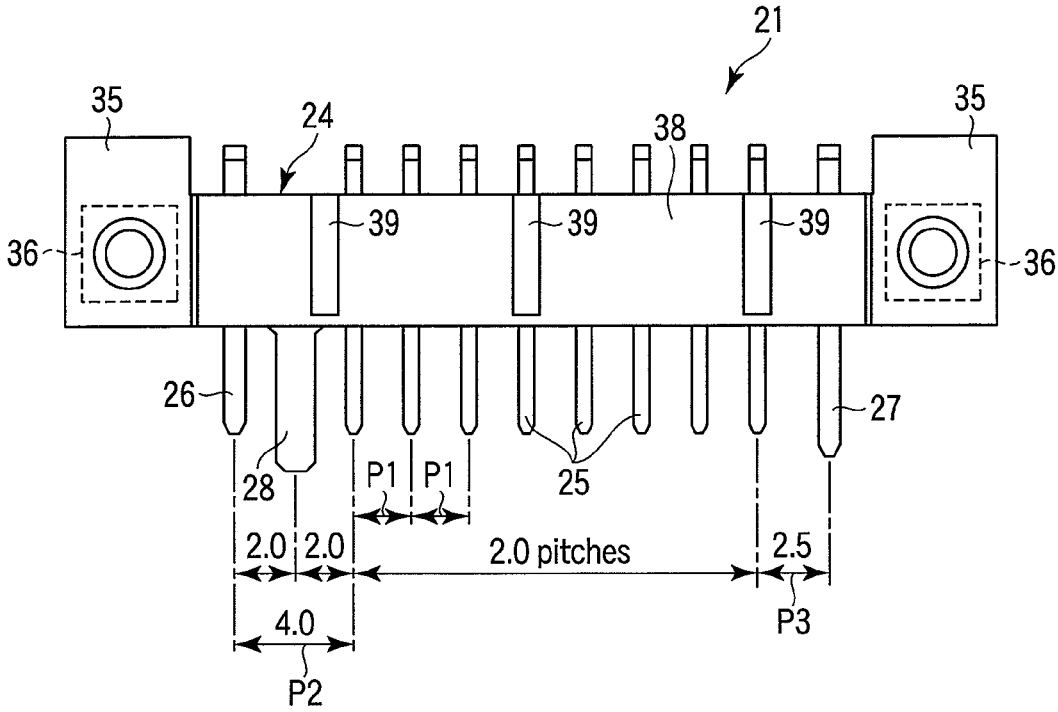
FIG. 9 is an exemplary plan view of a modification of the battery connector of FIG. 2.

As shown in FIG. 9, the positive terminal 26 is separated from the positioning pin 28 by 2.0 mm. Even in this modification, the second distance P2 is larger than the first distance P1. In this configuration, effects similar to those of the aforementioned embodiment can be anticipated.

As described above, in the structures of the aforementioned embodiment and the modification, it may be possible to realize miniaturization of the electronic apparatus 1 and the battery connector 19.

The invention is not limited to the aforementioned embodiment, and elements thereof may be diversely modified during implementation without departing from the spirit and scope of the invention. In addition, various changes to the invention may be made by suitably organizing a plurality of elements disclosed in the aforementioned embodiment. For example, some elements may be removed from all the elements described in the embodiment. Furthermore, elements of other embodiments may be suitably combined.

For example, it is not necessary to provide the positive and negative terminals 26 and 27 separately in both end portions of the battery connector 19. Instead, they may be provided in other areas such as the center portion of the battery connector 19. The widths W2 and W3 of the positive and negative terminals 26 and 27 may be substantially equal to the width W1 of the signal terminal 25. The first to third distances P1, P2, and P3 are not limited to the specific numerical values described in the embodiment, but may be modified diversely.

While certain embodiments of the invention have been described, these embodiments have been presented by way of example only, and are not intended to limit the scope of the inventions. Indeed, the novel embodiments described herein may be embodied in a variety of forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic apparatus connector, the battery connector comprising:

a first recess configured to receive a positioning pin;

a second recess configured to receive a signal terminal;

a first wall between the first recess and the second recess;

a third recess configured to receive a positive terminal, the first recess being between the second recess and the third recess;

a second wall, thicker than the first wall, between the first recess and the third recess; and a negative terminal, wherein the positive terminal protrudes from a housing, the positioning pin comprises an insulator and protrudes farther from the housing than does the positive terminal, and the negative terminal protrudes farther from the housing than does the positive terminal, the signal terminal being between the positioning pin and the negative terminal.

2. The electronic apparatus of claim 1, wherein the negative terminal is shorter than the positioning pin.

3. The electronic apparatus of claim 1, wherein the positive terminal and the negative terminal are each thicker than the signal terminal.

4. An electronic apparatus comprising:

a circuit board comprising a battery connector;

engaging portions in end portions of the battery connector; and a casing configured to accommodate the circuit board, and comprising holders configured to engage with the engaging portions of the battery connector, wherein the battery connector comprises:

a first recess configured to receive a positioning pin;

a second recess configured to receive a signal terminal;

a first wall between the first recess and the second recess;

a third recess configured to receive a power terminal, the first recess being between the second recess and the third recess, and a second wall, thicker than the first wall, between the first recess and the third recess.

5. An electronic apparatus comprising a battery connector, the battery connector comprising:

a first recess configured to receive a positioning pin;

a second recess configured to receive a signal terminal;

a first wall between the first recess and the second recess;

a third recess configured to receive a power terminal, the first recess being between the second recess and the third recess;

a second wall, thicker than the first wall, between the first recess and the third recess, a boss; and a fixing portion in an end portion of the battery connector, the power terminal being between the boss and the fixing portion.

6. An electric apparatus comprising:

a battery connector, the battery connector comprising:

a first recess configured to receive a positioning pin;

a second recess configured to receive a signal terminal;

a first wall between the first recess and the second recess;

a third recess configured to receive a power terminal, the first recess being between the second recess and the third recess; and a second wall, thicker than the first wall, between the first recess and the third recess;

a casing; and a battery attached to the casing, wherein:

the battery connector comprises a first connector and a second connector, the first connector comprising the positioning pin, the signal terminal, and the power terminal, the second connector comprising the first recess, the second recess, and the third recess and configured to connect the first connector, and the battery comprises either the first connector or the second connector.

7. The electronic apparatus of claim 6, wherein the battery connector further comprises a plurality of signal terminals separated from each other by a first distance, the power terminal comprises a positive terminal separated from the plurality of signal terminals by a second distance greater than the first distance, the positioning pin comprises an insulator and protrudes farther from a housing than the positive terminal, and the first connector further comprises a negative terminal protruding farther than the positive terminal, the plurality of signal terminals being between the positioning pin and the negative terminal.

8. The electronic apparatus of claim 6, wherein the casing comprises a portion in which either the first connector or the second connector is configured to be exposed, the portion configured to accommodate the battery.

9. The electronic apparatus of claim 6, further comprising a display panel.

10. The electronic apparatus of claim 6, wherein:

the first connector and the second connector configured to connect to each other in a direction crossing a thickness direction of the casing.

11. The electronic apparatus of claim 6, wherein:

the second connector comprises a housing, the housing comprising the first recess, the second recess, and the third recess.

* * * * *